US008005391B2

(12) United States Patent
Cook

(10) Patent No.: US 8,005,391 B2
(45) Date of Patent: Aug. 23, 2011

(54) METHODS FOR DETERMINING WHEN TO TRANSITION BETWEEN COLOR PRINTING AND BLACK-ONLY PRINTING IN AN IMAGE FORMING DEVICE

(75) Inventor: William Paul Cook, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 743 days.

(21) Appl. No.: 12/049,407

(22) Filed: Mar. 17, 2008

(65) Prior Publication Data

US 2009/0232538 A1 Sep. 17, 2009

(51) Int. Cl.
*G03G 15/00* (2006.01)
*G03G 15/01* (2006.01)

(52) U.S. Cl. ..... 399/82; 399/223; 399/228; 399/298

(58) Field of Classification Search ..... 399/82, 399/223, 228, 298, 299, 302
See application file for complete search history.

(56) References Cited

U.S. PATENT DOCUMENTS 6,029,023 A * 2/2000 Munemori et al. ..... 399/82
7,046,938 B2 * 5/2006 Yamamoto et al. ..... 399/82
7,349,658 B2 * 3/2008 Ogata et al. ..... 399/299

* cited by examiner

*Primary Examiner* — William J Royer

(57) ABSTRACT

The present application is directed to methods for determining when to transition between printing color images and printing black-only images in an image forming device. A variety of factors may be evaluated in order to select a trigger value. An examined portion of a print history and an examined portion of a print queue may be evaluated to determine one or more test values. Based on a comparison of the one or more test values with the trigger value, a determination may be made whether to transition between color printing and black-only printing.

20 Claims, 14 Drawing Sheets

METHODS FOR DETERMINING WHEN TO TRANSITION BETWEEN COLOR PRINTING AND BLACK-ONLY PRINTING IN AN IMAGE FORMING DEVICE

BACKGROUND

The present application is directed to methods for forming a toner image within an image forming device and, more particularly, to methods for determining when a transition should be made between color printing and black-only printing.

Color image forming devices contain two or more cartridges, each of which transfers a different color of toner to a media sheet as required to produce a full color copy of a toner image. One common image forming device includes four separate cartridges for each of yellow, magenta, cyan, and black colors. Image formation for each cartridge includes moving the toner from a reservoir to a developer member, from the developer member to a photoconductive member, and from the photoconductive member to either a media sheet or an intermediate member. The toner images from each cartridge are formed on the media sheet in an overlapping arrangement that ultimately forms the final composite toner image.

In many devices, each cartridge is driven during image formation, even when one or more colors are not being used for the specific print job. When the cartridge is driven, the developer member forces toner through multiple compressive nips, even when the developer member is not actually transferring toner. Repeatedly passing toner through the compressive nips inflicts some level of damage to the toner. Worn or damaged toner particles may fail to transfer or may transfer too readily to the photoconductive member. Thus, each time a given particle of toner passes through a nip, the likelihood of that particle responding to the image formation process decreases.

Methods to reduce or eliminate undue wear on the toner would result in better overall efficiency of the image forming device. This in turn would increase the amount of toner available for transfer to the media sheets, and would decrease the amount of wasted toner.

SUMMARY

The present application is directed to methods for determining when to transition between printing color images and printing black-only images in an image forming device. A variety of factors may be evaluated in order to select a trigger value. A portion of the print history and a portion of the print queue may be examined to determine one or more test values. Based on a comparison of the one or more test values with the trigger value, a determination may be made whether to transition between color printing and black-only printing.

DETAILED DESCRIPTION

Figure 1:
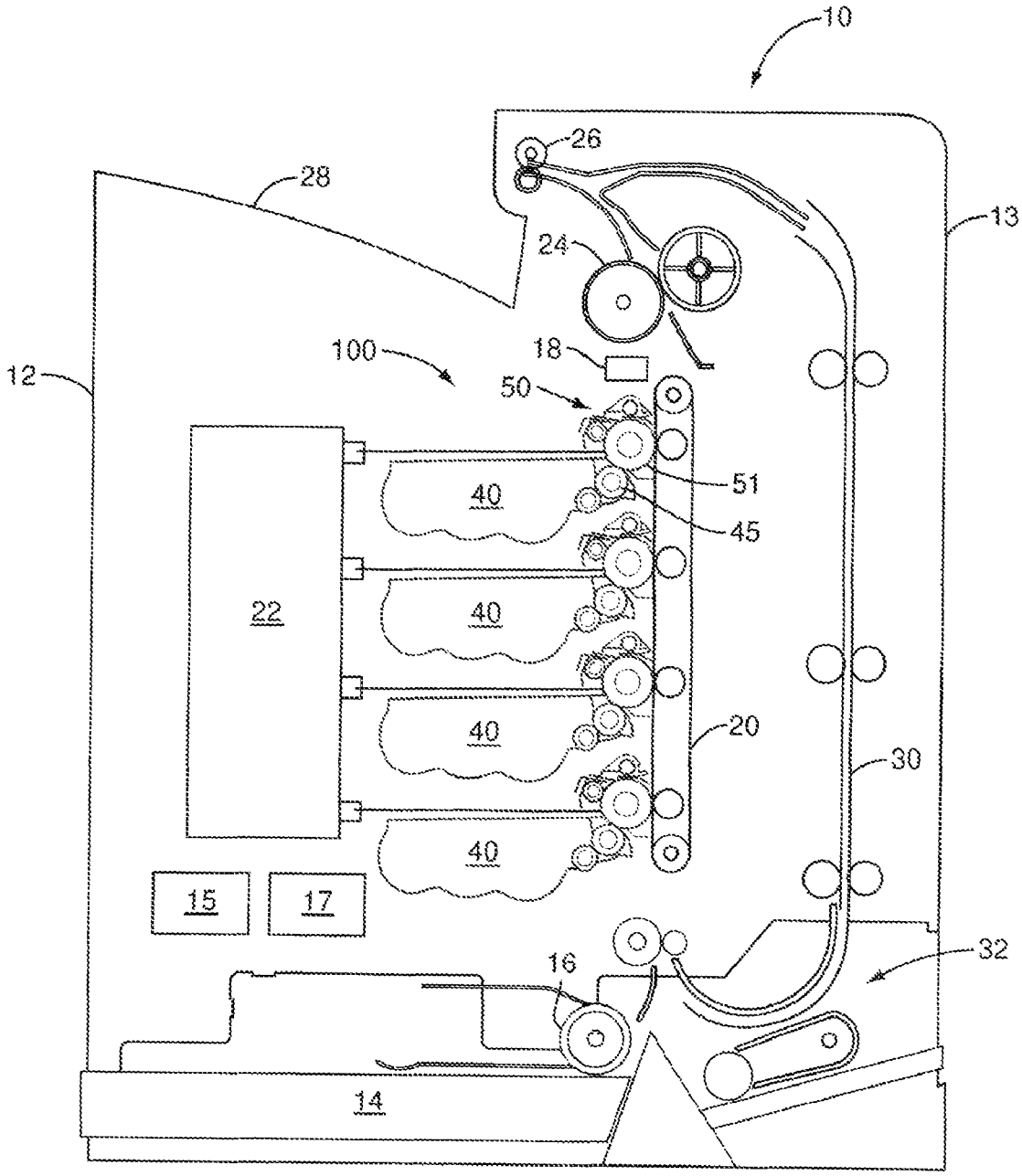
FIG. 1 is a schematic view of an image forming device according to one embodiment.

FIG. 1 illustrates a representative image forming device, such as a printer, indicated generally by the numeral 10. The image forming device 10 comprises a main body 12 and a subunit 13. A media tray 14 with a pick mechanism 16 or a manual input 32 are conduits for introducing media sheets in the device 10. The media tray 14 is preferably removable for refilling, and located on a lower section of the device 10.

Media sheets are moved from the input and fed into a primary media path. One or more registration rollers disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An imaging device 22 forms an electrical charge on a photoconductive member 51 within the image forming units 100 as part of the image formation process. The media sheet with loose toner is then moved through a fuser 24 that adheres the toner to the media sheet. Exit rollers 26 rotate in a forward or a reverse direction to move the media sheet to an output tray 28 or a duplex path 30. The duplex path 30 directs the inverted media sheet back through the image formation process for forming an image on a second side of the media sheet.

A controller 15 is included within the image forming device 10 to control creation and timing of the toner images, and movement of the media sheets. The controller 15 may include a microprocessor with associated memory. In one embodiment, the controller 15 includes a microprocessor, random access memory, read only memory, and an input/output interface. The controller 15 receives print requests and forms a print queue of each of the pages in the requests. The print queue may include the pages from a single print request, or may include pages from two or more different print requests. The controller 15 further includes a raster image processor that turns vector digital information received in the print requests into a high-resolution raster image. The controller 15 is then able to determine whether each of the pages requires a multi-color mode due to two or more colors of toner being necessary to form the image, or a mono-color mode when a single color (e.g., black) of toner is necessary to form the image.

The image forming units 100 are constructed of a cartridge 40 (in this embodiment, a developer unit) and a photoconductor unit 50. The cartridge 40, including a developer member 45, is positioned within the main body 12. The photoconductor unit 50, including the photoconductive member 51, is mounted to the subunit 13. In a closed orientation as illustrated in FIG. 1, the subunit 13 is positioned adjacent to the main body 12 with the photoconductive member 51 of the photoconductor unit 50 against the developer member 45 of the cartridge 40.

Figure 2:
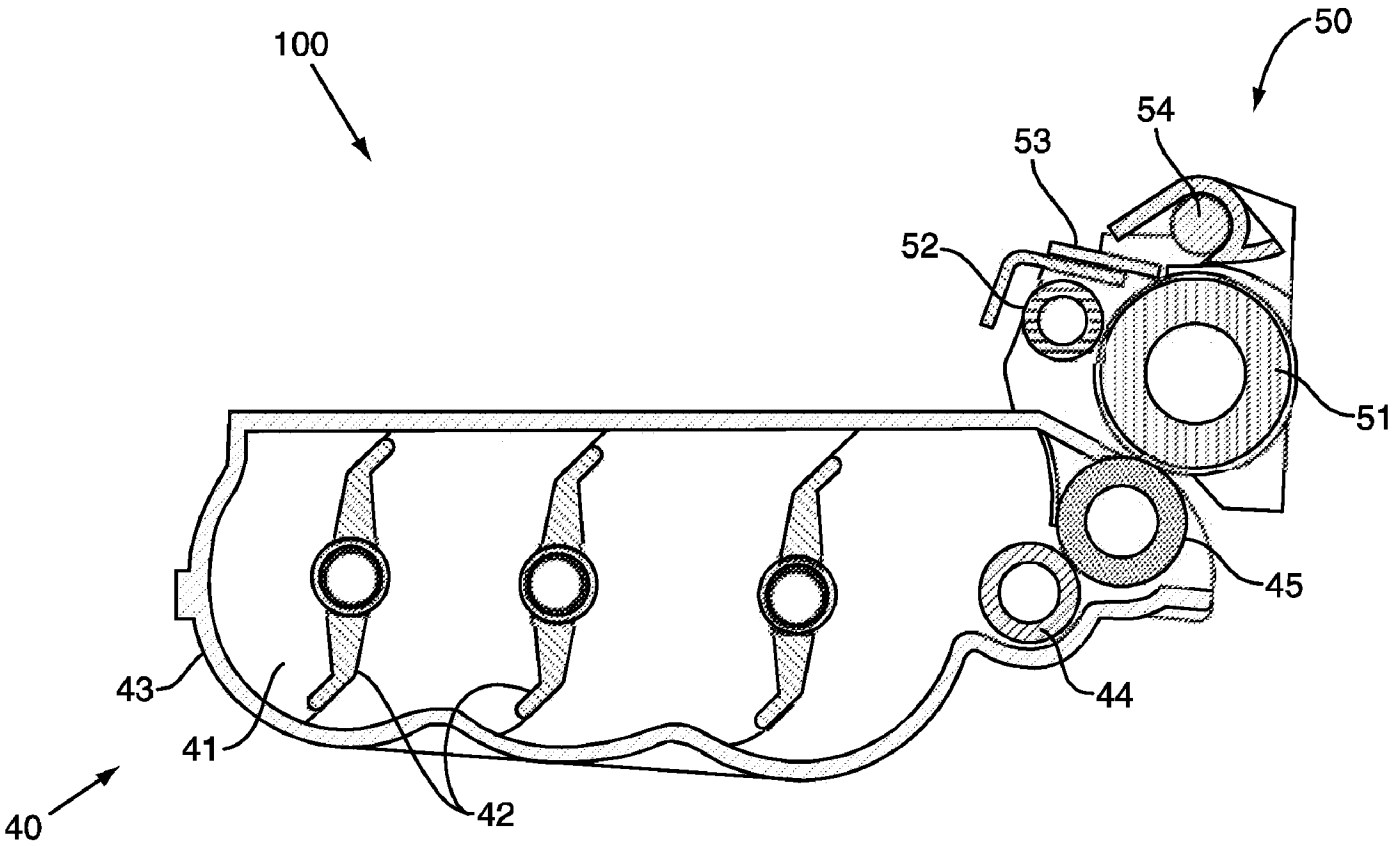
FIG. 2 is a cross-sectional view of an image forming unit according to one embodiment.
Figure 3:
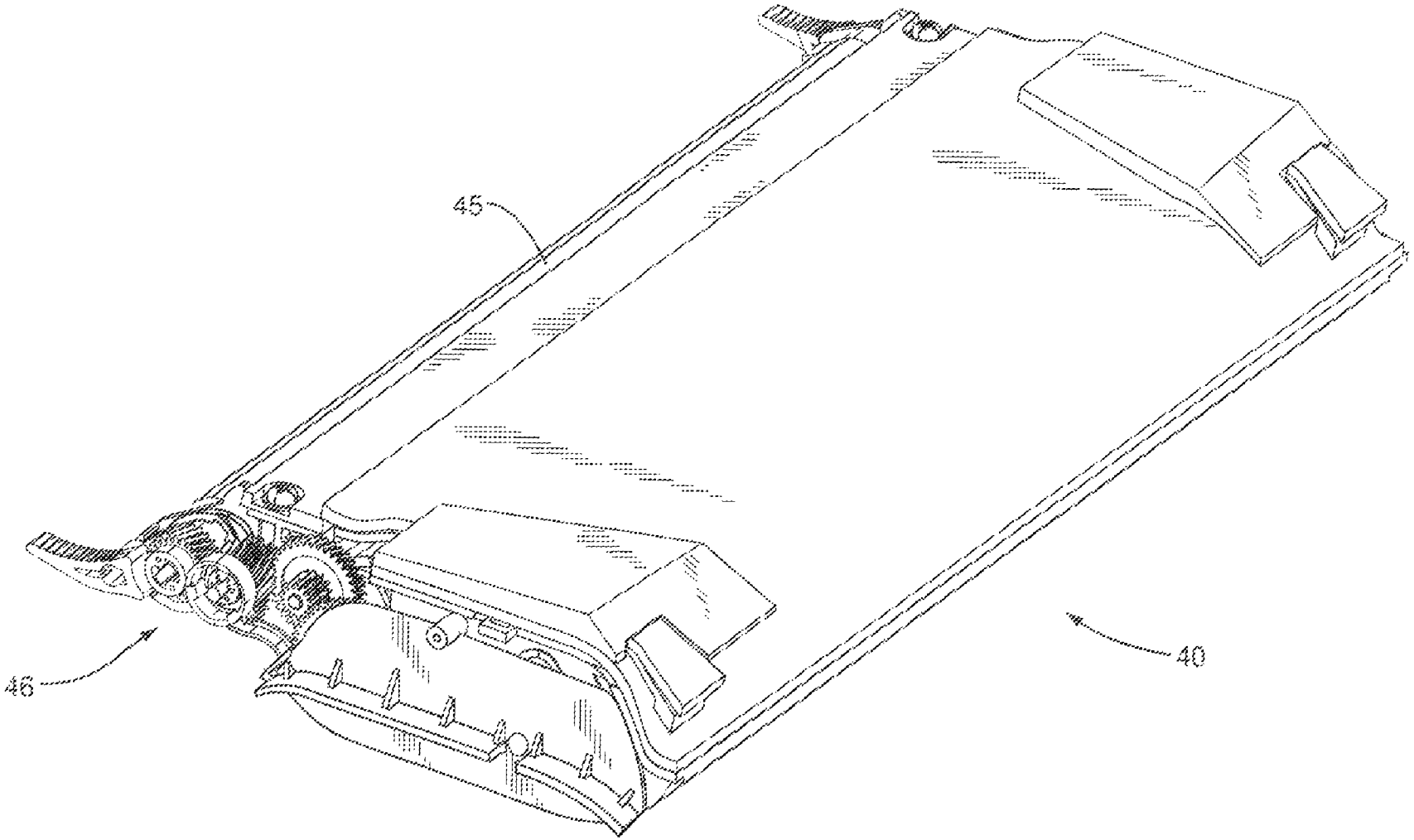
FIG. 3 is a perspective view of a developer unit according to one embodiment.

FIG. 2 illustrates a cross-sectional view of the image forming unit 100 in the closed orientation. The cartridge 40 comprises an exterior housing 43 that forms a reservoir 41 for holding a supply of toner. One or more agitating members 42 are positioned within the reservoir 41 for agitating and moving the toner towards a toner adder roll 44 and the developer member 45. Toner moves from the reservoir 41 via the one or more agitating members 42, to the toner adder roll 44, and finally is distributed to the developer member 45. The cartridge 40 is structured with the developer member 45 on an exterior section where it is accessible for being in contact with the photoconductive member 51 as illustrated in FIG. 3.

A drive motor 18 (see FIG. 1) may operatively connect to the gears 46 of the cartridge 40. In one embodiment, the drive motor 18 drives both the developer member 45 and the agitating members 42 by engaging one or more of the gears 46. The drive motor 18 may also drive more than one cartridge 40. In one embodiment, a single drive motor 18 drives the developer members 45 and agitating members 42 for the three color (magenta, cyan, and yellow) cartridges 40 in the image forming device 10. In this embodiment, the rotation of the developer members 45, as well as the agitating members 42, of all three color cartridges 40 may be stopped simultaneously by stopping the single drive motor 18. In another embodiment, each cartridge 40 has a dedicated drive motor 18.

Figure 4:
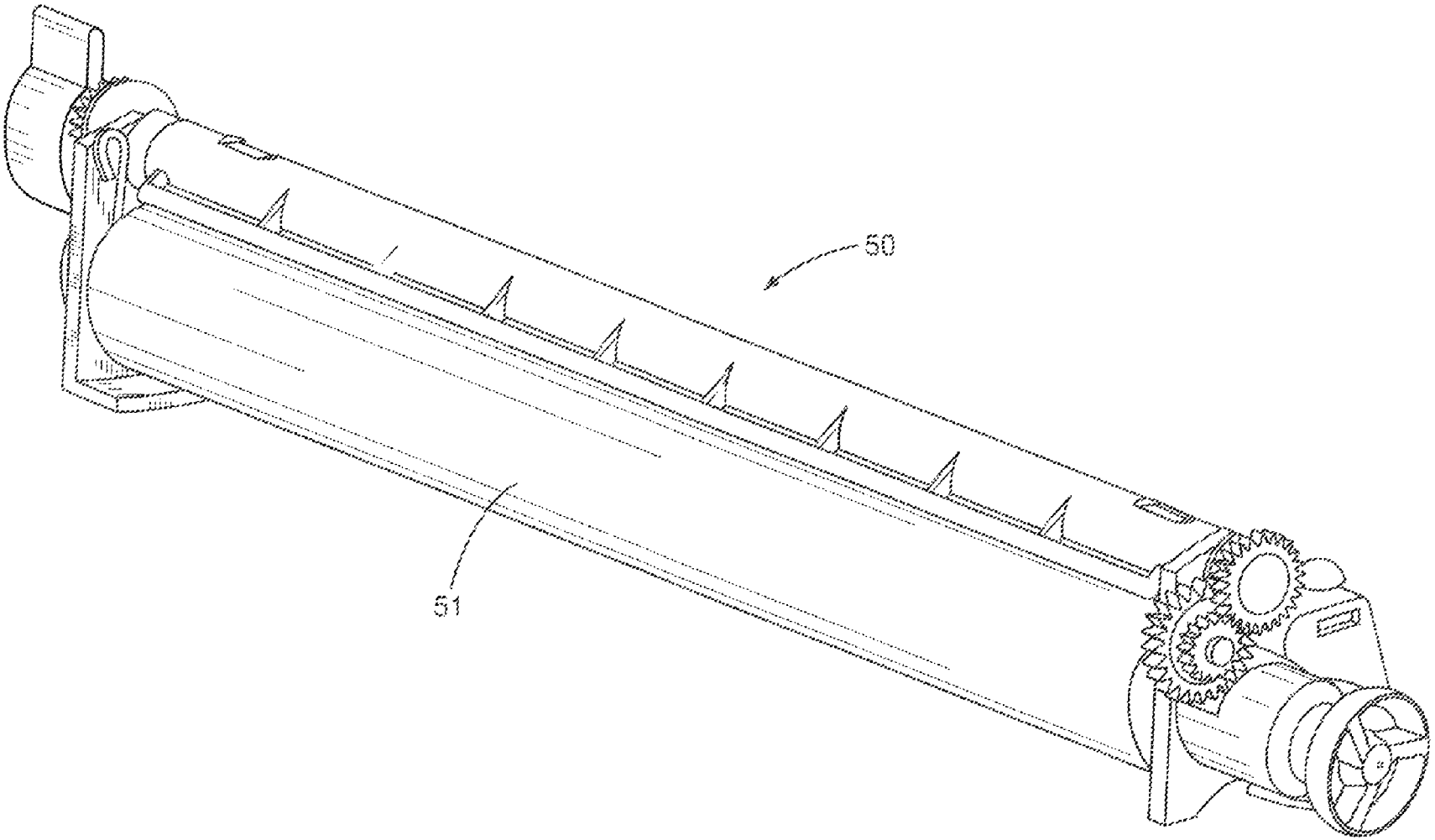
FIG. 4 is a perspective view of a photoconductor unit according to one embodiment.

The photoconductor unit 50 is illustrated in FIG. 2 and comprises the photoconductive member 51. The photoconductor unit 50 may also include a charger 52 that applies an electrical charge to the photoconductive member 51 to receive an electrostatic latent image from the imaging device 22. A cleaner blade 53 contacts the surface of the photoconductive member 51 to remove any toner that remains on the photoconductive member 51. The residual toner is moved to a waste toner auger 54 and moved out of the photoconductor unit 50. As illustrated in FIG. 4, the photoconductive member 51 is mounted on an exterior of the photoconductor unit 50 so it may be placed in contact with the developer member 45.

Figure 5:
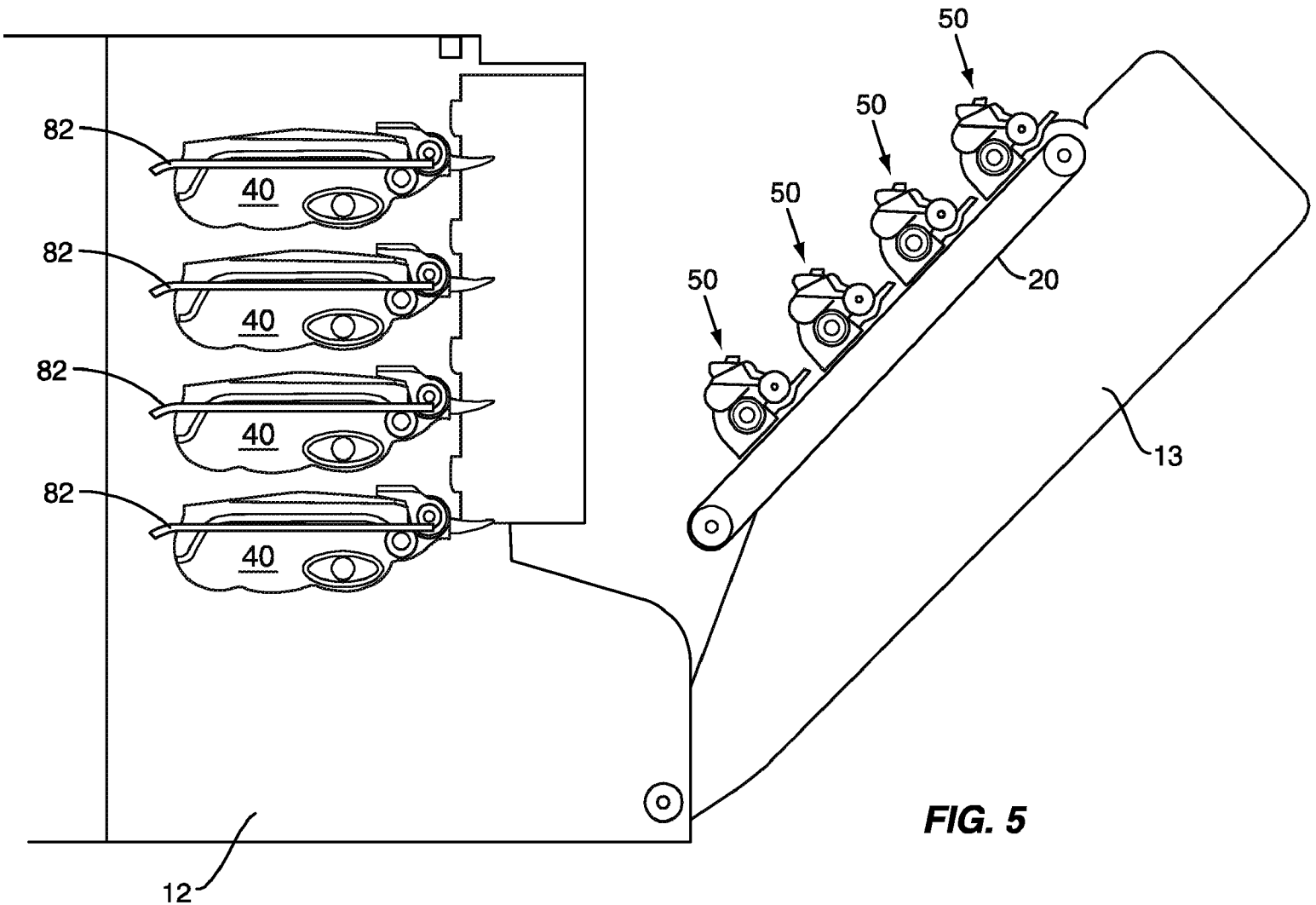
FIG. 5 is a cut-away side view of a subunit pivoted away from a main body of an image forming device according to one embodiment.

In an open orientation as illustrated in FIG. 5, the subunit 13 is moved away from the main body 12 separating the photoconductor unit 50 from the cartridge 40. This configuration provides direct and easy user access to the cartridge 40, photoconductor unit 50, and the media path. One embodiment of this two-piece cartridge design is described in U.S. Pat. No. 7,136,609 entitled "Movable Subunit and Two Piece Cartridge for Use in an Image Forming Device" issued on Nov. 14, 2006 and assigned to Lexmark International, Inc., the owner of the present application, and herein incorporated by reference in its entirety.

The image forming device 10 may include one or more power supplies, indicated generally by reference number 17 in FIG. 1. The power supply 17 may provide the voltage necessary to electrically bias the photoconductive member 51 and bias the developer member 45. In addition, the power supply 17 may provide power for a variety of motors and sensors located throughout the image forming device 10. The power supply 17 may, in some embodiments, be distributed to various locations within device 10, and may include suitable sections for AC and DC power, as is appropriate.

As illustrated in FIG. 5, the cartridge 40 includes guide rails 82 extending from two sides of the cartridge 40. The guide rails 82 are used for mounting the cartridge 40 in the main body 12 of the image forming device 10. The main body 12 includes a plurality of rollers 83 that extend outward and support the guide rails 82. In one embodiment, a non-gear side (FIG. 6) of the cartridge 40 is supported by two rollers 83, and a gear side (FIG. 7) is supported by one roller 83. When fully inserted, a back edge of the cartridge 40 contacts against one or more biasing members 85. The biasing members 85 may apply a force outward from the main body 12 (i.e., towards the right as illustrated in FIG. 5). One embodiment of the biasing members 85 is described in U.S. Pat. No. 7,082,275 entitled "Variable Force Biasing Mechanism and Electrical Connection" issued on Jul. 25, 2006 and assigned to Lexmark International, Inc., the owner of the present application, and herein incorporated by reference in its entirety. In one embodiment, the biasing members 85 provide an electrical contact between the main body 12 and the cartridge 40. Various embodiments may include biasing members 85 providing both electrical and mechanical contact, only electrical contact, or only mechanical contact.

Figure 6:
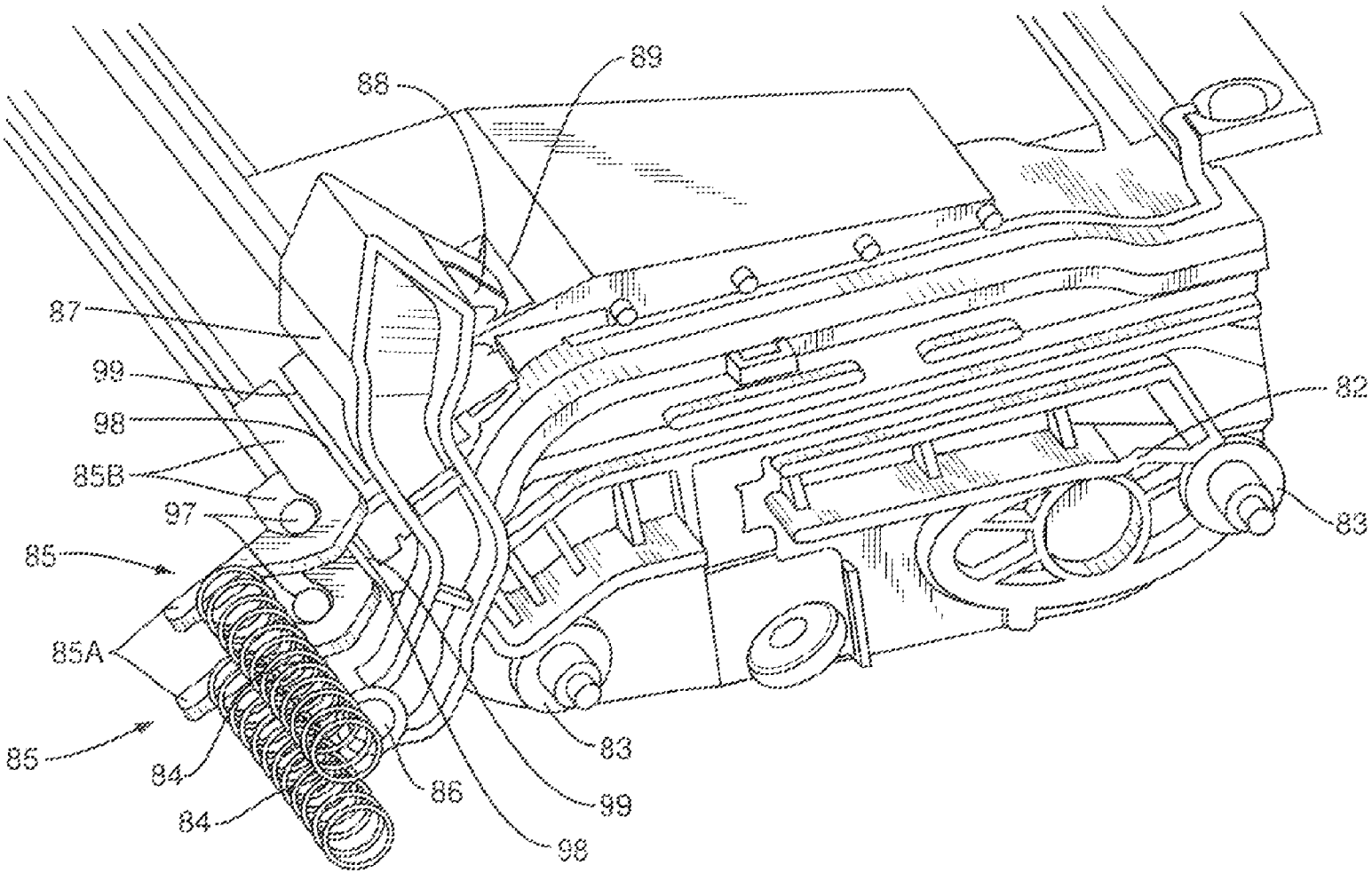
FIG. 6 is a partial perspective view of one side of a developer unit according to one embodiment.

FIG. 6 illustrates the cartridge 40 mounted in the main body 12 and in contact with the biasing members 85. The biasing member 85 may have a generally "L" shaped configuration, with a pivoting arm 85A pivotally disposed about a pivot member 97 and acted upon by a force generating member 84 (such as a spring). The pivot member 97 is rigidly affixed to the body 12 of the image forming device 10. As viewed in FIG. 6, the force generating member 84 causes the biasing member 85 to rotate in a clockwise direction. The biasing member 85 also includes a contacting arm 85B having a biasing edge 98. As the biasing member 85 rotates due to the action of the force generating member 84, the biasing edge 98 contacts the cartridge 40 at contact surface 99.

When the subunit 13 is in the closed position, the photoconductive member 51 contacts the developer member 45 of the cartridge 40, thereby generating a nip force between the two members 45, 51. Because the guide rails 82 of the cartridge 40 are positioned on the rollers 83, the cartridge 40 may tend to roll away from the photoconductive member 51 due to the nip force. However, the biasing members 85 oppose movement of the cartridge 40 and maintain the nip force between the photoconductive member 51 and the developer roller 45.

Figure 7:
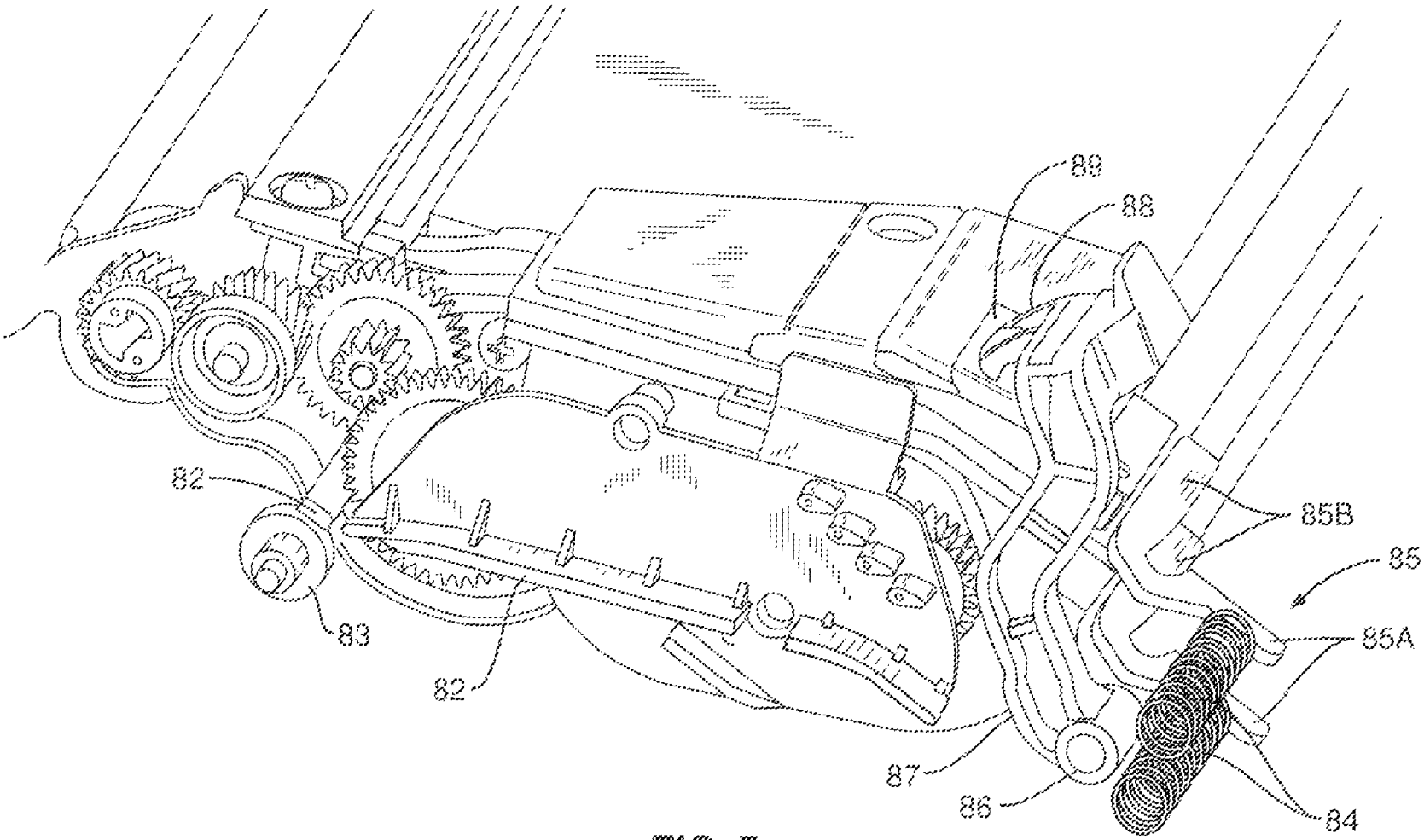
FIG. 7 is a partial perspective view of a second side of a developer unit according to one embodiment.

One or more electrical connectors 87 may also contact the cartridge 40. One embodiment includes two electrical connectors 87, one located in proximity to the non-gear side of the cartridge 40 as illustrated in FIG. 6, and the other located in proximity to the gear side of the cartridge 40 as illustrated in FIG. 7. One end of the electrical connector 87 is pivotably attached to the main body 12 at pivot 86. An end of the electrical connector 87 opposite from the pivot 86 includes a contactor 88 that engages the cartridge 40 at contact surface 89. A spring (not shown) may contact the electrical connector 87 and cause counter-clockwise rotation about the pivot 86 as viewed in FIG. 7 and urge the electrical connector 87 into contact with the cartridge 40. One embodiment of the electrical connector 87 is described in U.S. patent application Ser. No. 11/964,347 entitled "Electrical Connector for an Image Forming Device" filed on Dec. 26, 2007 and assigned to Lexmark International, Inc., the owner of the present application, and herein incorporated by reference in its entirety.

When the biasing members 85 and the electrical connectors 87 are in contact with the cartridge 40, the cartridge 40 is biased toward a printing (engaged) position in which the developer member 45 is in contact with the photoconductive member 51. As long as the cartridge 40 is in the printing position, the developer member 45 is rotated and the agitating members 42 churn the toner within the reservoir 41 through connection of at least one gear on the cartridge 40 with the drive motor 18. These actions occur regardless of whether the toner in the reservoir 41 will be used during image formation of the present toner image (for example, color toner may not be used when printing a black-only image). Thus, it would be advantageous to stop rotation of the developer member 45 and toner agitating members 42 when not required for the current image. This may prevent undesired consumption of color toner, as well as reduce the amount of toner churning. Before the developer member 45 and the agitating members 42 can be stopped, it may be advantageous to move the cartridge 40 away from the printing position to a retracted position such that the developer member 45 is spaced apart from (not in contact with) the photoconductive member 51.

Because the guide rails 82 of the cartridge 40 are supported by a plurality of rollers 83, the cartridge 40 may be free to slide along the rollers 83 in the absence of sufficient biasing force. Free movement of the cartridge 40 may be enhanced by sloping the guide rails 82 or the alignment of the rollers 83 such that gravitational forces cause the cartridge 40 to slide along the rollers 83 when the biasing forces are removed. Thus, by removing the biasing forces, the cartridge 40 may move to the retracted position, at which time the rotation of the developer member 45 and agitating members 42 may be stopped.

FIGS. 8A-8D illustrate one embodiment of a bias control arm 91 operative to adjust the biasing force on one or more cartridges 40 within the main body 12. Bias control arm 91 comprises an elongated structure movable in the direction indicated by arrow A. The bias control arm 91 includes one or more positioning members 93 that translate the movement of the bias control arm 91 into movement of the cartridge 40 in the direction indicated by arrow B. The direction of arrow B is different than the direction of arrow A, and in one embodiment the directions are approximately perpendicular. One embodiment of the bias control arm 91 is described in U.S. patent application Ser. No. 12/049,422 entitled "Devices and Methods for Retracting a Cartridge in an Image Forming Device" filed on Mar. 17, 2008 and assigned to Lexmark International, Inc., the owner of the present application, and herein incorporated by reference in its entirety.

Figure 8A:
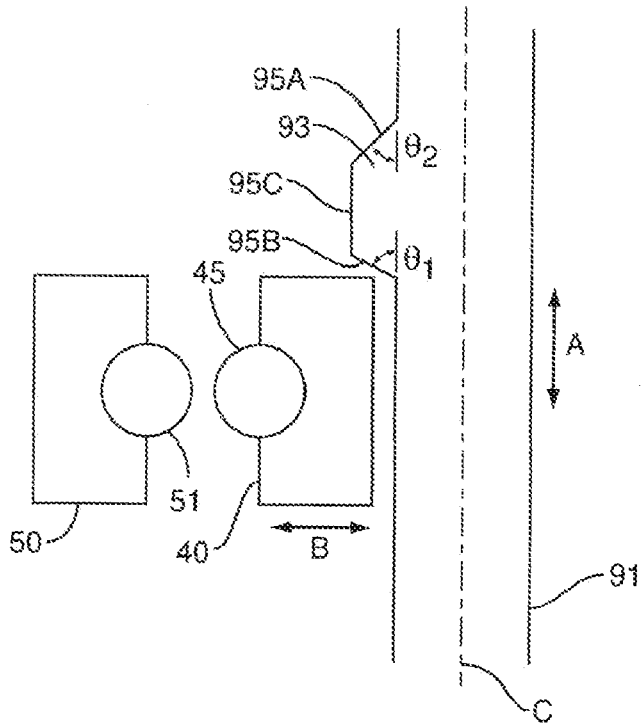
FIGS. 8A-8D are schematic views of a bias control arm contacting a cartridge according to one embodiment.

The translation of movement is affected by lower positioning surface 95B. As the bias control arm 91 moves downward as illustrated in FIG. 8A, the lower positioning surface 95B contacts the cartridge 40. The lower positioning surface 95B is oriented at an angle .theta..sub.1 with respect to a centerline C of the bias control arm 91. As the bias control arm 91 continues to move downward, the angled lower positioning surface 95B exerts a biasing force on the cartridge 40 that pushes the cartridge 40 to the left as viewed in FIG. 8B until the developer member 45 contacts the photoconductive member 51. A maximum nip force between the developer member 45 and the photoconductive member 51 may be generated when a middle positioning surface 95C is in contact with the cartridge 40 as illustrated in FIG. 8C. In one embodiment, an amount of downward movement of the bias control arm 91 depends on a desired nip force.

Figure 8B:
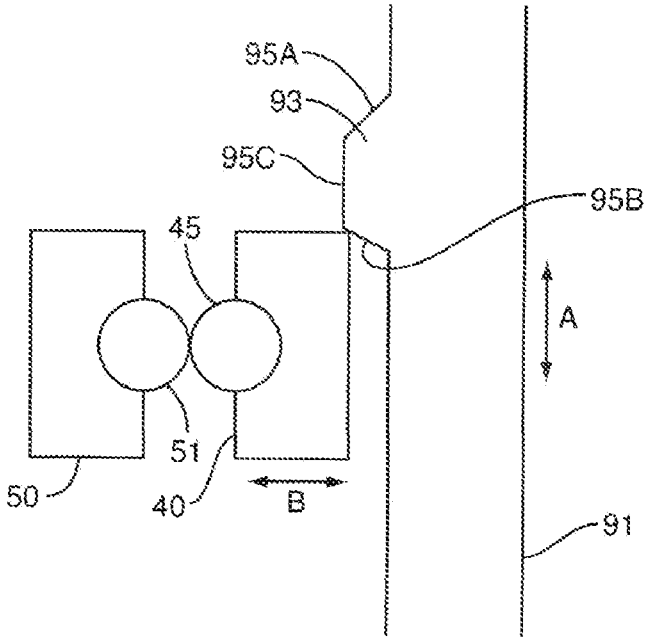
Figure 8C:
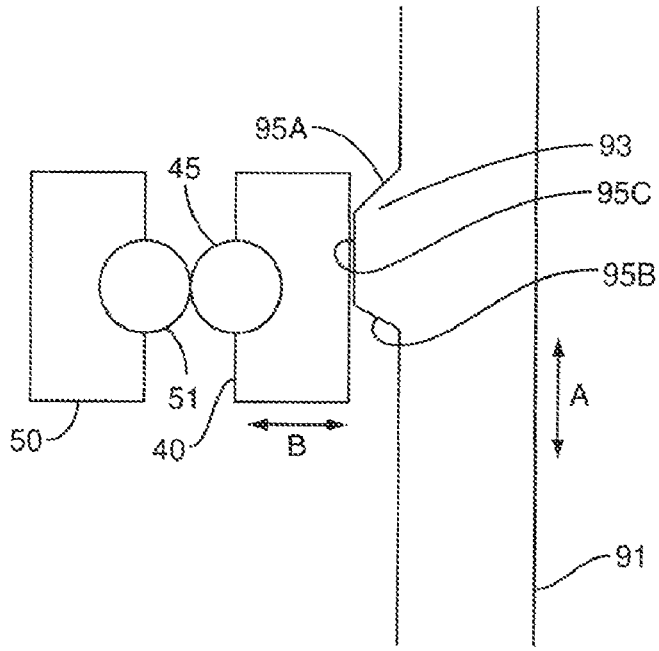
Figure 8D:
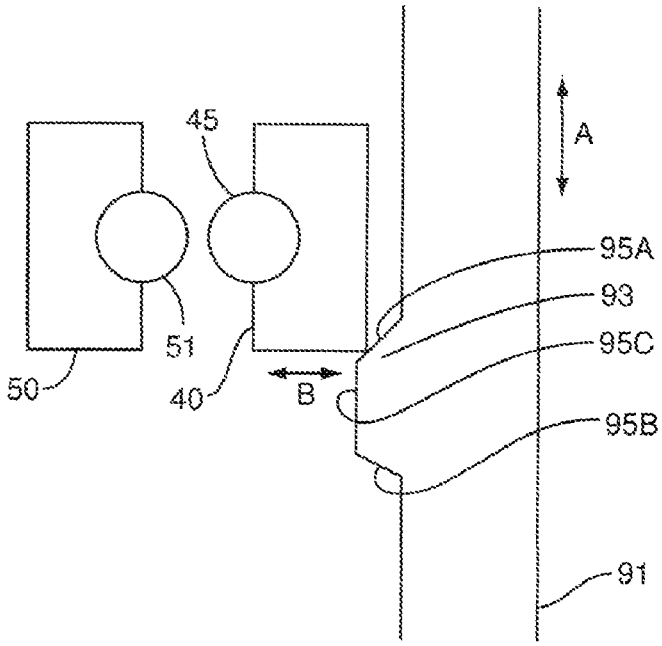

To lessen or remove the biasing force from the developer member 45, the bias control arm 91 may be moved upward to reverse the sequence illustrated in FIGS. 8A-8C. Alternatively, the bias control arm 91 may be moved further downward until upper positioning surface 95A is in contact with the cartridge 40 as illustrated in FIG. 8D. The bias control arm 91 may be moved (upward or downward) until the biasing force is reduced to a level where the cartridge 40 moves away from the photoconductor unit 50, spacing the developer member 45 away from the photoconductive member 51. An angle $\theta_2$ at which the upper positioning surface 95A is oriented to the centerline C may be the same as or different than angle $\theta_1$.

Figure 9:
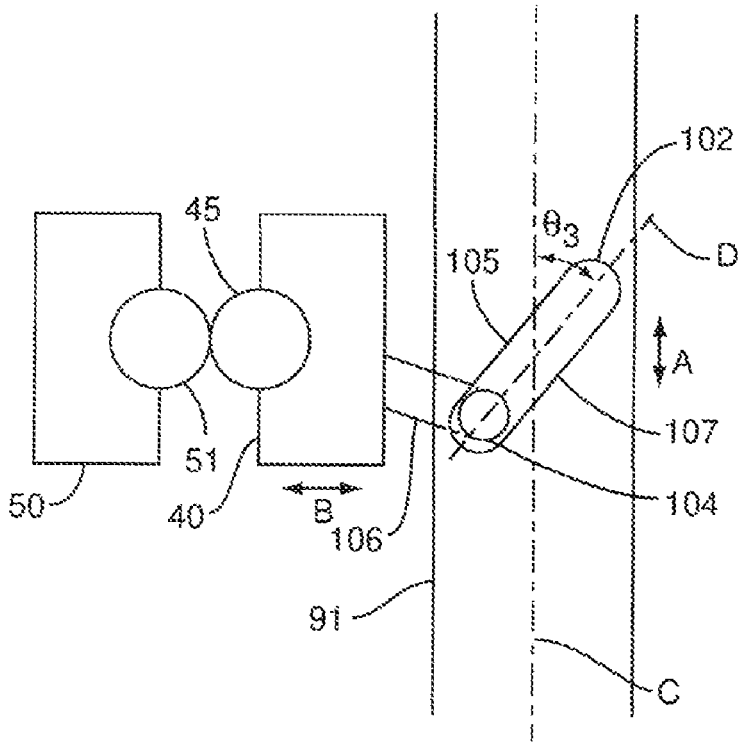
FIG. 9 is a schematic view of a bias control arm according to one embodiment.

In another embodiment as illustrated in FIG. 9, the angled positioning surfaces that cause the cartridge 40 to move in the direction of arrow A are located internally to the bias control arm 91 rather than on an outer surface as illustrated in FIGS. 8A-8D. In this embodiment, one end of a connecting rod 106 is in contact with the cartridge 40, and another end is connected to a pin 104. The pin 104 is in communication with a slot 102 in the bias control arm 91. The slot 102 has a centerline D which is oriented at an angle $\theta_3$ to the centerline C of the bias control arm 91. Thus, as illustrated in FIG. 9, as the bias control arm 91 moves downward, the pin 104 is forced upward in the slot 102 by positioning surfaces 105, 107, and the cartridge 40 moves away from the photoconductor unit 50, and the developer member 45 is spaced apart from the photoconductive member 51. Conversely, as the bias control arm 91 moves upward, the pin 104 moves toward the lower end of the slot 102, and the developer member 45 is brought into contact with the photoconductive member 51. As the angle $\theta_3$ increases (that is, the centerline D becomes more horizontal as viewed in FIG. 9), a given amount of movement of the bias control arm 91 in the direction of arrow A results in less movement of the cartridge 40 in the direction of arrow B.

Figure 10:
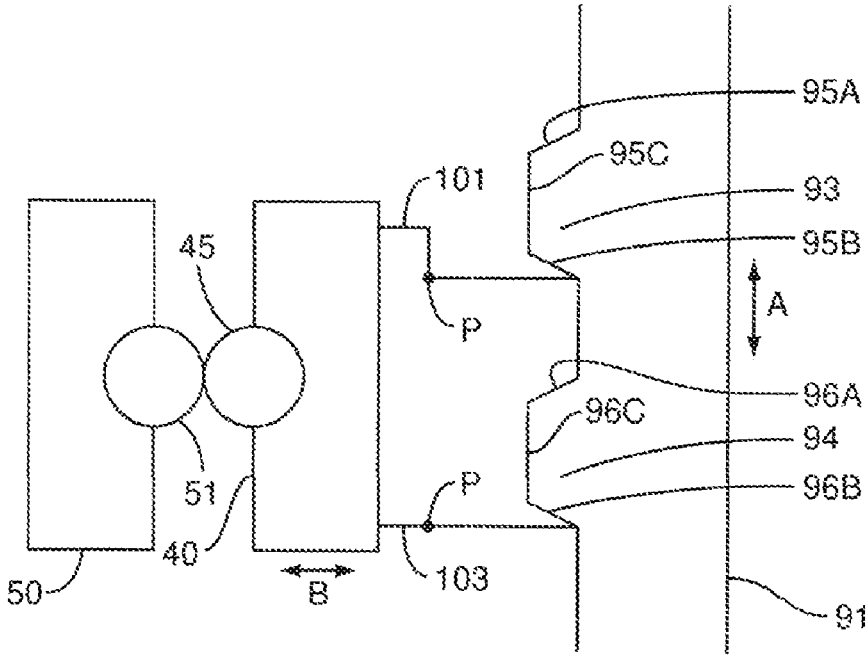
FIG. 10 is a schematic view of a bias control arm according to one embodiment.

While FIGS. 8A-8D and 9 illustrate the bias control arm 91 directly providing the biasing force for the cartridge 40, in another embodiment one or more intermediate members may provide the biasing force, and the bias control arm 91 acts upon these intermediate members. FIG. 10 illustrates two members 101, 103 maintaining the cartridge 40 in a position such that the developer member 45 is in contact with the photoconductive member 51. While FIG. 10 illustrates both members 101, 103 present, other embodiments may include only one member 101, 103. Similar to the description above, as the bias control arm 91 moves downward as viewed in FIG. 10, lower positioning surfaces 95B, 96B of positioning members 93, 94 contact the members 101, 103. As the bias control arm 91 continues to move downward, the members 101, 103 pivot about pivot points P and at least partially retract from the cartridge 40. At some point, a force exerted by the members 101, 103 on the cartridge 40 decreases such that the cartridge 40 moves away from the photoconductor unit 50.

Figure 11:
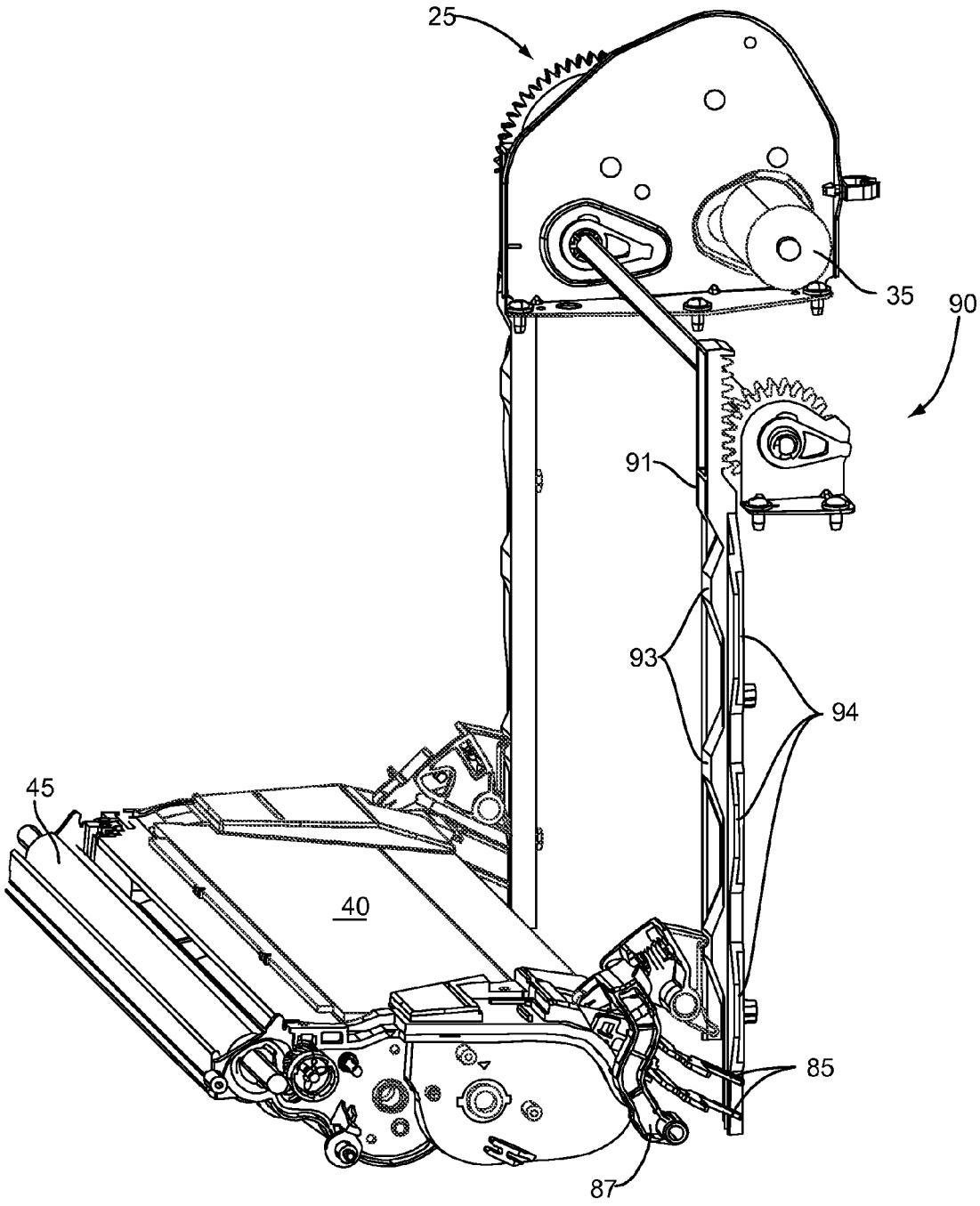
FIG. 11 is a perspective view of a cartridge and subassembly including a bias control arm according to one embodiment.

FIG. 11 illustrates one embodiment of a subassembly 90 operative to remove or lessen the biasing force on one or more cartridges 40 using the bias control arm 91 with two positioning members 93, 94. In this embodiment, two biasing members 85 and one electrical connector 87 contact each end of the cartridge 40. The subassembly 90 retracts one or more of the biasing members 85 and electrical connectors 87 from contact with the cartridge 40. The subassembly 90 includes a motor 35 operatively connected through a gear train 25 to the bias control arm 91. The bias control arm 91 is configured to selectively disengage one or more of the biasing members 85 and electrical connectors 87 from contact with the cartridge 40. As one or more of the biasing members 85 and electrical connectors 87 are disengaged, the biasing force exerted on the cartridge 40 is reduced until the cartridge 40 slides along the rollers 83 away from the printing position.

For purposes of clarity, only a single cartridge 40 is illustrated in FIG. 11, although typically four cartridges 40 would be in place in a vertical arrangement as illustrated in FIG. 1. The subassembly 90 may be configured to work on any or all of the cartridges 40. In one embodiment, the subassembly 90 is configured to retract the biasing members 85 and/or the electrical connectors 87 associated with the three color cartridges 40 (i.e., magenta, cyan, and yellow) in a four-color printer, but not the black cartridge 40.

The bias control arm 91 includes a first set of positioning members 93 disposed toward the cartridge 40, and a second set of positioning members 94 disposed at about 90 degrees from the first set of positioning members 93. The first set of positioning members 93 are operative to change the position of the electrical connectors 87, and the second set of positioning members 94 are operative to change the position of the biasing members 85 as discussed in greater detail below. The positioning members 93, 94 include angled positioning surfaces 95A, 95B, 96A, 96B (see FIG. 10) that contact and at least partially retract either the biasing members 85 and/or the electrical connectors 87. Positioning member 93 further includes surface 95C disposed between angled positioning surfaces 95A and 95B, and positioning member 94 further includes surface 96C disposed between angled positioning surfaces 96A and 96B. As the biasing members 85 and/or the electrical connectors 87 are retracted, the biasing force on the cartridge 40 is reduced until finally the cartridge 40 moves away from the photoconductor unit 50, and the developer member 45 is spaced apart from the photoconductive member 51.

As stated previously, it may be advantageous to stop the developer member 45 and the agitating member 42 in the color cartridge 40 when printing black-only images. In one embodiment, this may be achieved by retracting the color cartridge 40 from the photoconductor unit 50. One embodiment of a method for transitioning between color and black-only printing is described in U.S. patent application Ser. No. 12/049,432 entitled "Methods to Control Transitions Between Color Printing and Black-Only Printing in an Image Forming Device" filed on Mar. 17, 2008, issued as U.S. Pat. No. 7,826,774, and assigned to Lexmark International, Inc., the owner of the present application, and herein incorporated by reference in its entirety.

However, before initiating a method to make the physical transition between color and black-only printing, the controller 15 may determine an advantageous point in an examined portion of the print queue at which to make the transition. The decision as to when a transition should take place may depend on a variety of factors. Each transition may require a delay time before printing a subsequent image to allow for the transition to take place. Thus, the more transitions that take place, the greater the impact on throughput. The controller 15 should balance the toner wear reduction achieved for each transition with the resulting reduction in throughput.

For example, consider a simplex print job that contains ten images, with each odd numbered image a color image and each even numbered image a black-only image. If the color cartridge 40 is retracted from the photoconductor unit 50 after each color image so that the color cartridge 40 may be shut off while printing the black-only images, then at least nine transitions would be required for this print job (retracting the color cartridge 40 after each color image and engaging the color cartridge 40 after each black-only image). Assuming that each transition could be completed in the time it takes to print one image, then the throughput would be reduced by about half. Typically, such an impact on throughput would be unacceptable, even considering the toner wear savings.

Consider another ten page print job in which the third image is a color image and all the rest are black-only images. Assuming that the color cartridge 40 is engaged (color printing position) at the start of the job, there are at least two options for when to make the transition. The first option is to leave the color cartridge 40 in the engaged position while printing the first through third images, then making the transition between the third and fourth images. The benefit to this option is that there would only be a single transition to affect throughput, at the expense of additional wear on the toner resulting from churning the toner while printing the first two black-only images. The second option is to retract the color cartridge 40 before printing the first image, engage the color cartridge 40 for the third image, and again retract the color cartridge 40 after printing the third image. This option reduces the amount of wear on the toner while printing the first two images, but requires three transitions instead of one. The increased number of transitions in the second option may reduce throughput more than the first option.

Figure 12A:
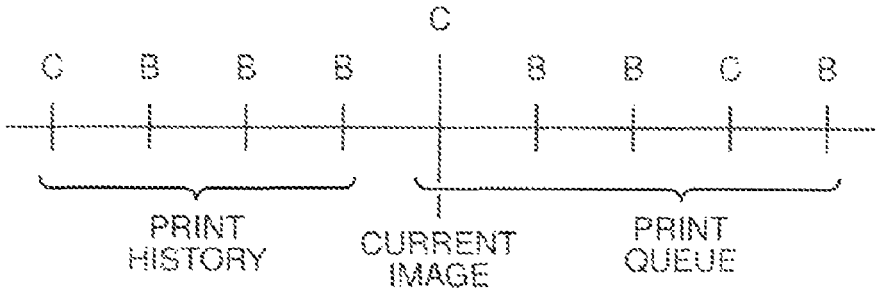
FIGS. 12A-12C are schematic diagrams of an examined portion of a print history and an examined portion of a print queue according to one embodiment.
Figure 12B:
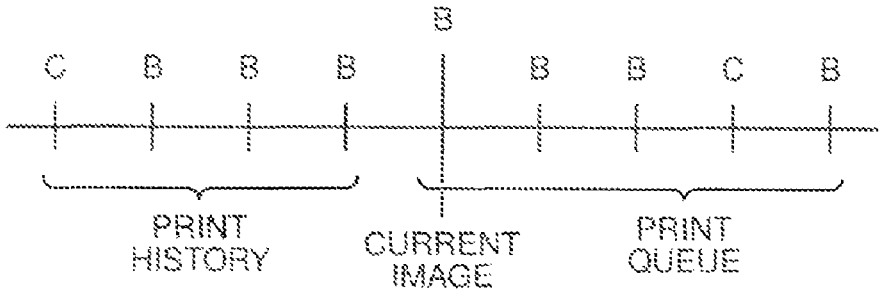
Figure 12C:
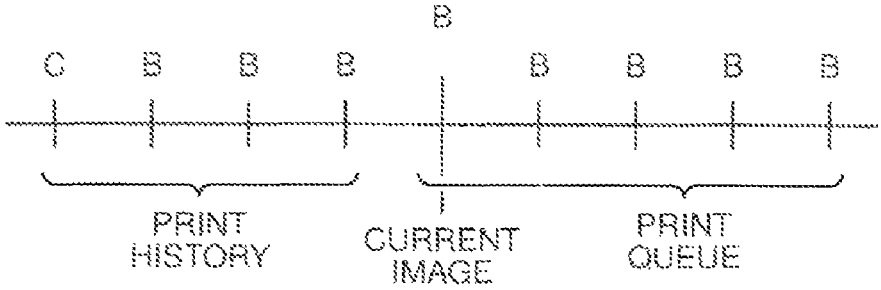

Therefore, it may be advantageous to use an algorithm that considers a variety of factors related to making the transition, and uses those factors to balance the gain from reduced toner wear with reduced throughput to decide when the transition should take place. As described above, the images in the examined portion of the print queue may influence the decision to make a transition. Similarly, the algorithm may use an examined portion of the print history (recently printed images) to predict when a transition should be made. In one embodiment, the examined portion of the print history is used to predict how many sequential black-only images will be printed before a color image is to be printed. In one embodiment, both an examined portion of the print queue and the examined portion of the print history are used by the algorithm. FIGS. 12A-12C schematically illustrate examined portions of the print history and print queue including color images (C) and black-only (B) images that may be visible to the controller 15, and the use of this information in the algorithm is described below. While FIGS. 12A-12C illustrate four images in both the examined portion of the print history and the examined portion of the print queue, other amounts are also contemplated. The number of print history and print queue images visible to the controller 15 may be limited by the complexity of the images and an amount of available memory.

Figure 13:
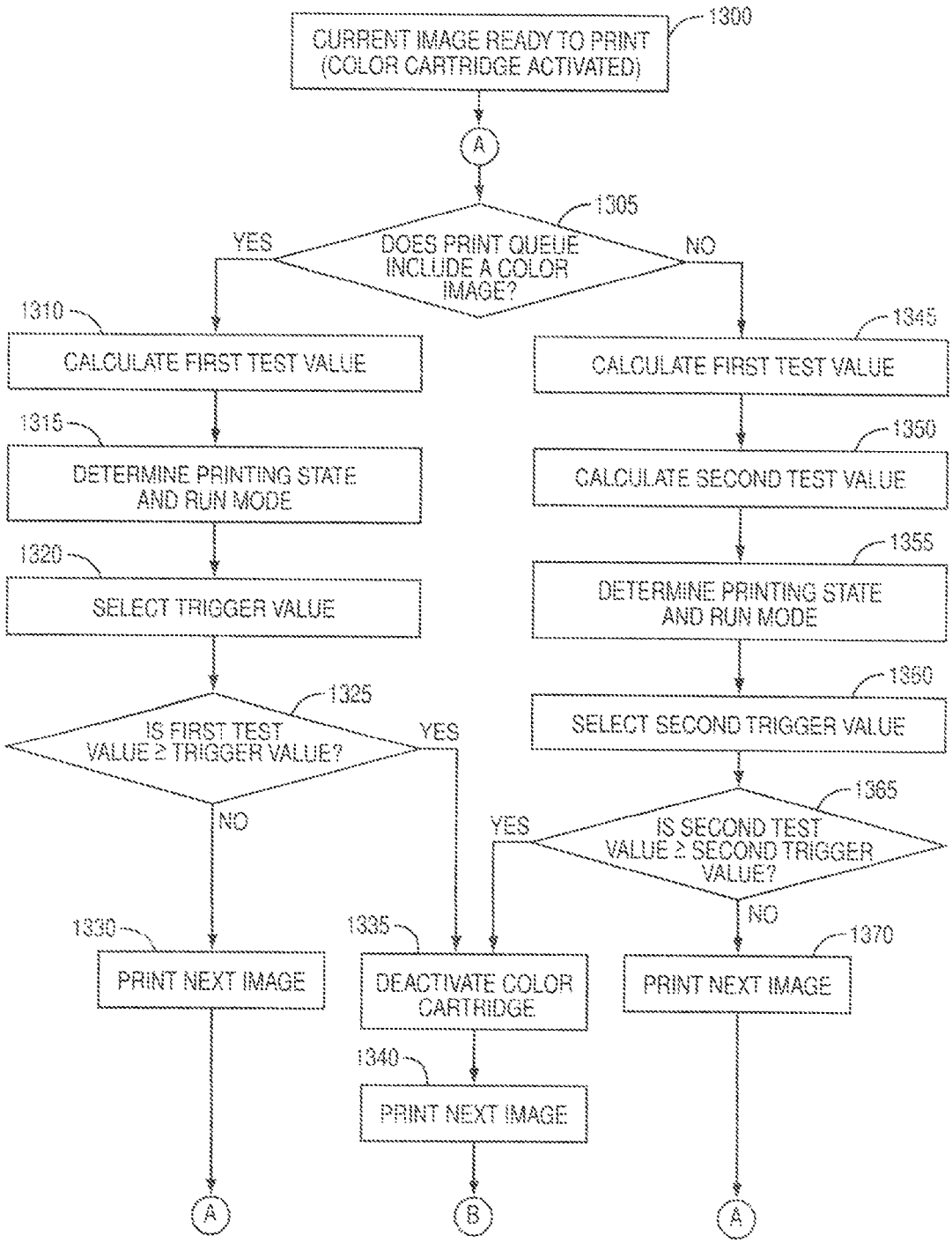
FIG. 13 is a process diagram of a method for determining when to transition between color printing and black-only printing according to one embodiment.

FIG. 13 illustrates a process diagram for one embodiment of an algorithm for determining when to transition between color and black-only printing. In one embodiment, transitioning between color and black-only printing includes moving the color cartridge 40 between an engaged position and a disengaged position. In the engaged position, the color developer member 45 is positioned in contact with the color photoconductive member 51, and is ready for color printing. In the disengaged position, the color developer member 45 is spaced from the color photoconductive member 51, and black-only printing may occur. In another embodiment, transitioning between color and black-only printing includes shutting off the color cartridge 40 without spacing the color developer member 45 from the color photoconductive member 51. When the color cartridge 40 is turned on, the color printing may occur, and black-only printing may occur when the color cartridge 40 is turned off. As used herein, the term "activated" means that the color printing may occur, and the term "deactivated" means that black-only printing may occur, regardless of the position of the color developer member 45 and the color photoconductive member 51. This embodiment uses a single color cartridge 40. However, it is understood to one skilled in the art that the algorithm is applicable to all of the color cartridges 40 or a portion of the color cartridges 40. Additionally, the algorithm could be used for the black cartridge 40.

In FIG. 13, starting with the color cartridge 40 activated (ready for color printing), a current color image is ready to be printed (step 1300). The controller 15 then examines the images in the examined portion of the print queue to determine if a color image is present (step 1305). In the embodiment illustrated in FIG. 12A, four images are visible to the controller 15 in the examined portion of the print queue, one of which is a color image (C). Since one of the images in the examined portion of the print queue is a color image, the algorithm does not need to predict when a color image will occur (or, conversely, how many sequential black-only images (B) are in the examined portion of the print queue) and, therefore, does not require the examined portion of the print history. Therefore, the algorithm need only evaluate the examined portion of the print queue, and a first test value is calculated (step 1310). The first test value is the number of sequential black images in the examined portion of the print queue, starting with the current image. Including the current image assures that the color cartridge 40 will remain activated if the current image is a color image. As illustrated in FIG. 12A, the current image is a color image, so the sequential number of black-only images in the examined portion of the print queue is zero, which is the value assigned to the first test value.

Next, the controller 15 determines a printing state and a run mode (step 1315) of the image forming device 10. The printing state is either color or black-only printing. In this example, the printing state is color because the color cartridge 40 is activated. There may be three run modes, defined as simplex, duplex, and idle. In simplex mode, each sheet receives an image on only one side of the sheet. Both sides of the sheet receive an image in duplex mode. Additionally, the image forming device 10 may operate under either of two types of duplex modes. The first duplex mode is a "one-up" mode in which both sides of each sheet are imaged prior to imaging either side of the next sheet. The second duplex mode is a "two-up" mode in which at least one image is printed on a second sheet before both images are printed on a first sheet. Idle mode includes periods when the image forming device 10 has not been operated for a period of time, as well as any interpage gap that is equal to or greater than the time required to either activate or deactivate the color cartridge 40.

A trigger value is then selected based on the printing state, run mode, and whether a color image is visible in the examined portion of the print queue (step 1320). In general, the trigger values may be selected to provide a balance between reducing toner wear by disengaging the color cartridge 40 and increasing throughput by not transitioning the color cartridge 40. The exact trigger values selected for a particular embodiment will depend on a variety of factors including whether toner wear or higher throughput is deemed more important, and the amount of available memory (which at least partially determines how many images in the print history and print queue are visible to the controller 15). A set of trigger values for one embodiment is presented in Table 1. The values in Table 1 are exemplary and are not intended to be limiting.

TABLE 1

| Selection Criteria (color printing state) | Trigger Value |
|---|---|
| Idle mode, color image not visible in the examined portion of the print queue | 1 |
| Idle mode, color image visible in the examined portion of the print queue | 3 |
| Simplex mode, color image not visible in the examined portion of the print queue | 2 |
| Simplex mode, color image visible in the examined portion of the print queue | 3 |
| Duplex mode, color image not visible in the examined portion of the print queue | 2 |
| Duplex mode, color image visible in the examined portion of the print queue | 4 |

The first test value is compared to the trigger value (step 1325). If the first test value is greater than or equal to the trigger value, then the color cartridge 40 is deactivated (step 1335), and the next image is then printed in black-only mode (step 1340). Printing continues in the deactivated (black-only) mode according to the method illustrated in FIG. 14 as discussed below. Returning to step 1325, if the first test value is less than the trigger value, the color cartridge 40 remains activated and the image is printed in the color mode (step 1330). The above steps are then repeated starting at step 1305.

Returning to step 1305, if the examined portion of the print queue does not include a color image, then the controller 15 may use both the number of sequential black images in the examined portion of the print queue, starting with the current image (the first test value) and the examined portion of the print history. Thus, a second test value is calculated (step 1350) as the sum of the first test value (determined in step 1345) and the number of sequential black-only images immediately preceding the current image. As described above, the printing state and the run mode are determined (step 1355). A second trigger value is then selected based on the printing state, run mode, and whether a color image is visible in the examined portion of the print queue (step 1360). The second test value is then compared to the second trigger value (step 1365). If the second test value is greater than or equal to the second trigger value, then the color cartridge 40 is deactivated (step 1335), and the next image is then printed in the black-only mode (step 1340). Printing continues in the black-only mode according to the method illustrated in FIG. 14 as discussed below. Returning to step 1365, if the first test value is less than the trigger value, the color cartridge 40 remains activated and the image is printed in the color mode (step 1370). The above steps are then repeated starting at step 1305.

For the example illustrated in FIG. 12A, the printing state is color and the run mode is simplex. A color image is visible in the examined portion of the print queue (the fourth image in the examined portion of the print queue in FIG. 12A). According to Table 1, the trigger value is 3 for these selection criteria. The first test value is the number of sequential black images in the examined portion of the print queue, starting with the current image. The current image in FIG. 12A is a color image, so the first test value is zero. Therefore, the first test value is less than the trigger value, and the current image is printed in the color state. Once the color image is printed, the first test value is recalculated, and the procedure starts over based on the images visible in the examined portion of the print queue and the examined portion of the print history at that point.

By way of a second example as illustrated in FIG. 12B, the current image is now a black-only image rather than a color image. The first test value would then be 3 because there would be three sequential black-only images in the examined portion of the print queue. The trigger value is the same as that selected for the above example using FIG. 12A. Now, the first test value equals the trigger value and the color cartridge 40 would be deactivated.

By way of a third example as illustrated in FIG. 12C, the current image is a black-only image and all four images visible in the examined portion of the print queue are black-only images. According to Table 1, the trigger value for this example is 2. Because there is no color image visible in the examined portion of the print queue, the second test value is calculated. The second test value is 8 (5 black-only images visible in the examined portion of the print queue starting with the current image, plus 3 black-only images immediately preceding the current image in the examined portion of the print history). Since the second test value is greater than the trigger value, the color cartridge 40 is deactivated.

Figure 14:
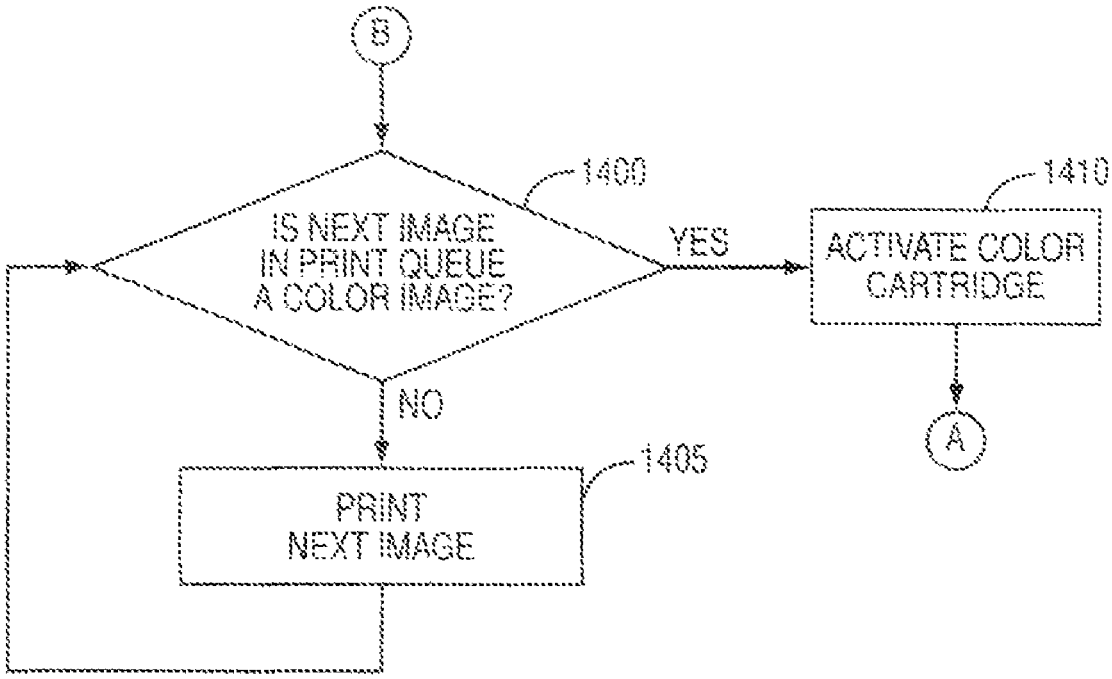
FIG. 14 is a process diagram of a method for determining when to transition between black-only printing and color printing according to one embodiment.

FIG. 14 illustrates one embodiment of a method to determine when to transition from black-only printing to color printing. The transition when in the black-only state is not dependent upon either the first or second test value. The image forming device 10 may continue to operate in the black-only state and evaluate whether each image is a color image (step 1400). If the next image is a black-only image, the image is printed (step 1405). This procedure is repeated until the next image to be printed is a color image, at which point the color cartridge 40 is activated (step 1410), and the procedure continues at step 1305 of FIG. 13.

When the image forming device 10 is operating in duplex mode, throughput may be adversely affected when trying to simultaneously transport sheets in the duplex path 30 and transition between color and black-only printing. Therefore, one embodiment includes the following simplifying assumptions for duplex mode. When the image forming device 10 is operating in the one-up duplex mode, both images of a duplex sheet are counted as color images if either image is a color image. For the two-up duplex mode (in which at least one image is printed on a second sheet before both images are printed on a first sheet) all four images of the two sheets are counted as color images if at least one of the images is a color image. In another embodiment for the two-up duplex mode, if the first sheet has at least one color images, then both images on the first sheet are counted as color images. If a transition is called for between the first and second page, the first page may be printed in the one-up mode, and the two-up mode will start at the second page. While these simplifying assumptions may lead to increased wear on the toner because fewer transitions are made, productivity may increase as a result of higher throughput.

In another embodiment, a large interpage gap may exist when the duplex sheet is being transported through the duplex path 30. If this interpage gap is at least as long as the time required to make the transition, the transition may be hidden within the interpage gap without affecting throughput.

In one embodiment, the color cartridge 40 is activated upon initial power up of the image forming device 10, and/or when the image forming device 10 returns to idle after completing a print job. Either of these situations corresponds to step 1300 in FIG. 13. When printing the first image upon startup or after returning to idle, the controller 15 may activate or deactivate the color cartridge 40 to coincide with the first image, regardless of the images in the examined portions of the print history and print queue. Because of the time required to pick and move the media sheet from the media tray 14 at startup or after returning to idle, there may be sufficient time to activate or deactivate the color cartridge 40 as needed for the first image. After printing the first image, the controller 15 would continue at step 1305 of FIG. 13. Thus, if the first image at startup or after returning to idle is a black-only image and the sequential images in the examined portion of the print queue are all black-only images, then the color cartridges 40 may not be activated while printing these black-only images.

In another embodiment, the color cartridge 40 is deactivated upon initial power up of the image forming device 10 and/or when the image forming device 10 returns to idle after completing a print job. As described above, the controller 15 may activate or deactivate the color cartridge 40 as needed for the first image, then start at step 1300 of FIG. 13 if the first image is a color image, or start at step 1400 of FIG. 14 if the first image is a black-only image. Alternatively, the color cartridge 40 may remain either in the same activated or deactivated state as it was in for the last image printed before the image forming device 10 was shut down or before returning to idle.

In one embodiment, the controller 15 may include a learning function that can vary the trigger values depending on past printing history over a specified amount of time or number of images. In this embodiment, an initial set of trigger values (e.g., Table 1) may be programmed into the controller 15. The controller 15 monitors the print history over the specified amount of time or number of images and may vary the trigger values based on the print history. For example, the print history may show that, on average, at least ten black-only pages are printed prior to printing each color image, Therefore, the appropriate trigger values may be varied to allow more black-only pages to be printed before transitioning to color printing.

The embodiments described above relate to a two-piece cartridge in which the developer unit 40 is contained in one piece, and the photoconductor unit 50 is contained in the other piece. In another embodiment, the cartridge is a single piece (e.g., image forming unit 100) and contains both the developer unit 40 and the photoconductor unit 50 in that one piece. In this latter embodiment, the bias control arm 91 may, for example, bias the image forming unit 100 toward the transport belt 20 to form a nip between the photoconductive member 51 and a transfer roller. The methods described above may be used to determine when to deactivate the image forming unit 100 by moving the image forming unit 100 away from the transport belt 20, at which point the image forming unit 100 may be deactivated, reducing toner churn as described above.

In image forming devices 10 that include multiple cartridges (either one-piece or two-piece embodiments) 40, one or more of the cartridges 40 may be deactivated. The one or more cartridges 40 may be deactivated by moving the cartridge 40 or shutting off the cartridge 40. The methods described above may be used to determine when to deactivate the one or more cartridges 40.

The term "image forming device" and the like is used generally herein as a device that produces images on a media sheet. Examples include but are not limited to a laser printer, ink-jet printer, fax machine, copier, and a multi-functional machine. One example of an image forming device is Model No. C530 from Lexmark International of Lexington, Ky.

The term "imaging device" refers to a device that arranges an electrical charge on the photoconductive member 51. Various imaging devices may be used such as a laser printhead and a LED printhead.

The transport belt 20 is illustrated in the embodiments for moving the media sheets past the image forming units 100, and as part of the subunit 13. In another embodiment, roller pairs are mounted to the subunit 13 and spaced along the media path. The roller pairs move the media sheets past the image forming units 100. In one embodiment, each of the roller pairs is mounted on the subunit 13. In another embodiment, one of the rollers is mounted on the subunit 13, and the corresponding roller of the pair is mounted on the main body 12. In yet another embodiment, rollers may be positioned within the photoconductor unit 50.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method for determining when to deactivate a color cartridge in an image forming device, comprising:

activating the color cartridge;

calculating a first test value as a number of sequential black-only images in an examined portion of a print queue, starting with a current image;

calculating a second test value as a sum of the first test value and a number of sequential black-only images immediately preceding the current image in an examined portion of a print history;

selecting a predetermined trigger value based on a printing state of the image forming device, a run mode of the image forming device, and whether the examined portion of the print queue includes a color image;

when the examined portion of the print queue includes a color image, comparing the first test value to the predetermined trigger value;

when the examined portion of the print queue includes all black-only images, comparing the second test value to the predetermined trigger value; and deactivating the color cartridge based on the comparison of the first or second test value to the predetermined trigger value.

2. The method of claim 1, wherein selecting the predetermined trigger value based on the printing state of the image forming device comprises selecting the predetermined trigger value based on whether the image forming device is operating in a color state or a black-only state.

3. The method of claim 1, wherein selecting the predetermined trigger value based on the run mode of the image forming device comprises selecting the predetermined trigger value based on whether the image forming device is operating in simplex, duplex, or idle mode, the idle mode including interpage gaps equal to or greater than an amount of time required to deactivate the color cartridge.

4. The method of claim 1, wherein deactivating the color cartridge based on the comparison of the first or second test value to the predetermined trigger value comprises deactivating the color cartridge when either the first or second test value is greater than or equal to the predetermined trigger value.

5. The method of claim 1, wherein when calculating the first and second test values and the image forming device is operating in a duplex mode in which both images of a first duplex sheet are printed before printing either image of a second duplex sheet, each duplex sheet is counted as two color images if at least one image is a color image.

6. The method of claim 1, wherein when calculating the first and second test values and the image forming device is operating in a duplex mode in which at least one image of a second duplex sheet is printed prior to printing both images of a first duplex sheet, the first and second duplex sheets are counted as four color images if at least one image is a color image.

7. The method of claim 1, further comprising:

determining an interpage gap between the current image and a next image in the examined portion of the print queue;

comparing the interpage gap to an amount of time required to deactivate the color cartridge; and deactivating the color cartridge when the interpage gap is greater than or equal to the time required to deactivate the color cartridge and all the images in the examined portion of the print queue are black-only images.

8. The method of claim 1, further comprising recalculating the first and second test values after printing each image.

9. The method of claim 1, further comprising after deactivating the color cartridge, activating the color cartridge when the next image to be printed in the examined portion of the print queue is a color image.

10. A method for determining when to deactivate a color cartridge in an image forming device, comprising:

activating the color cartridge;

counting a sequential number of black-only images immediately preceding a current image in an examined portion of a print history;

counting a sequential number of black-only images in an examined portion of a print queue, starting with a current image;

determining if the examined portion of the print queue includes a color image;

determining a printing state of the image forming device;

determining a run mode of the image forming device;

selecting a trigger value based on whether the examined portion of the print queue includes a color image, the printing state, and the run mode; and determining when to deactivate the color cartridge based on a comparison of at least one of the number of sequential black-only images in the examined portion of the print history and the number of sequential black-only images in the examined portion of the print queue, with the trigger value.

11. The method of claim 10, wherein determining the printing state comprises determining whether the image forming device is operating in a color state or a black-only state.

12. The method of claim 10, wherein determining the run mode comprises determining whether the image forming device is operating in a simplex, duplex, or idle mode.

13. The method of claim 10, wherein determining when to deactivate the color cartridge comprises determining when to deactivate the color cartridge based on a comparison of the number of sequential black-only images in the examined portion of the print queue with the trigger value, when the examined portion of the print queue includes a color image.

14. The method of claim 10, wherein determining when to deactivate the color cartridge comprises determining when to deactivate the color cartridge based on a comparison of a sum of the number of sequential black-only images immediately preceding the current image in the examined portion of the print history and the number of sequential black-only images in the examined portion of the print queue with the trigger value, when the examined portion of the print queue includes all black-only images.

15. The method of claim 10, further comprising after deactivating the color cartridge, activating the color cartridge when the next image to be printed in the examined portion of the print queue is a color image.

16. A method for determining when to deactivate a color cartridge in an image forming device, comprising:

activating the color cartridge;

determining whether an examined portion of a print queue includes a color image;

when the examined portion of the print queue includes a color image, calculating a first test value as a number of sequential black-only images in the examined portion of the print queue beginning with a first image in the examined portion of the print queue;

comparing the first test value with a first trigger value and deactivating the color cartridge when the first test value is greater than or equal to the first trigger value;

when the examined portion of the print queue includes all black-only images, calculating a second test value as a sum of the first test value and a number of sequential black-only images immediately preceding the first image in an examined portion of a print history; and comparing the second test value with a second trigger value and deactivating the color cartridge when the second test value is greater than or equal to the second trigger value.

17. The method of claim 16, wherein comparing the first and second test values with the first and second trigger values comprises comparing the first and second test values with the first and second trigger values selected based on one or more factors including a printing state and a run mode of the image forming device.

18. The method of claim 17, wherein selecting the first and second trigger values based on the printing state comprises selecting the first and second trigger values based on whether the image forming device is operated in a color state or black-only state.

19. The method of claim 17, wherein selecting the first and second trigger values based on the run mode comprises selecting the first and second trigger values based on whether the image forming device is operating in a simplex, duplex, or idle mode.

20. The method of claim 16, further comprising after deactivating the color cartridge, activating the color cartridge when the first image in the examined portion of the print queue is a color image.

* * * * *